US010384358B2

(12) United States Patent
Nayna et al.

(10) Patent No.: US 10,384,358 B2
(45) Date of Patent: Aug. 20, 2019

(54) HAIR CLIPPING DEVICE

(71) Applicant: KONINKLIJKE PHILIPS N.V., Eindhoven (NL)

(72) Inventors: Matthew Gerard Nayna, Eindhoven (NL); Geert-Jan Darwinkel, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 117 days.

(21) Appl. No.: 15/524,645

(22) PCT Filed: Oct. 27, 2015

(86) PCT No.: PCT/EP2015/074780
§ 371 (c)(1),
(2) Date: May 5, 2017

(87) PCT Pub. No.: WO2016/071144
PCT Pub. Date: May 12, 2016

(65) Prior Publication Data

US 2017/0341245 A1 Nov. 30, 2017

(30) Foreign Application Priority Data

Nov. 6, 2014 (EP) ..... 14192128

(51) Int. Cl.
*B26B 19/06* (2006.01)
*B26B 19/12* (2006.01)
(Continued)

(52) U.S. Cl.
CPC ..... *B26B 19/205* (2013.01); *B26B 19/063* (2013.01); *B26B 19/12* (2013.01);
(Continued)

(58) Field of Classification Search
CPC ..... B26B 19/205; B26B 19/3846; B26B 19/3893; B26B 19/063; B26B 19/12; B26B 19/3813; B26B 19/284; B26B 19/20
See application file for complete search history.

(56) References Cited

U.S. PATENT DOCUMENTS 356,434 A * 1/1887 Washburn ..... B26B 19/20 30/202
1,516,635 A * 11/1924 Friedman ..... B26B 19/205 30/202
(Continued)

FOREIGN PATENT DOCUMENTS

EP 1535708 A1 6/2005
EP 1645375 A1 4/2006
(Continued)

*Primary Examiner* — Jonathan G Riley

(57) ABSTRACT

The present invention relates to a hair clipping device (10) which comprises a housing (14), a cutting assembly (16) including a stationary cutting blade (32) and a moveable cutting blade (34), a drive arrangement (42) for driving the moveable cutting blade (34) relative to the stationary cutting blade (32) in an oscillatory movement along a first axis (40), a comb support element (45) for removably attaching a comb attachment (12) with a plurality of comb teeth (50), and an adjustment unit (58) for adjusting the position of the comb attachment (12) relative to the cutting assembly (16), when the comb attachment (12) is attached to the comb support element (45), wherein the adjustment unit (58) is configured to increase a distance between the comb attachment (12) and the cutting assembly (16) during an extension movement of the adjustment unit (58), and to decrease the distance between the comb attachment (12) and the cutting assembly (16) during a retraction movement of the adjustment unit (58). The hair clipping device (10) further comprises an end stop element (74) which is configured to
(Continued)

prevent a movement of the comb attachment (12) towards the cutting assembly (16) during the retraction movement when a minimal distance between the comb attachment (12) and the cutting assembly (16) is reached by contacting the comb support element (45). The end stop element (74) is further configured to cause a coupling of the adjustment unit (58) with one of the stationary cutting blade (32) and the moveable cutting blade (34) if the retraction movement of the adjustment unit (58) is continued after the minimal distance between the comb attachment (12) and the cutting assembly (16) is reached after a contact of the end stop element (74) with the comb support element (45). Said coupling enables an adjustment of the position of the moveable cutting blade (34) relative to the stationary cutting blade (32) along a second axis (56) transverse to the first axis (40) by means of the adjustment unit (58).

9 Claims, 5 Drawing Sheets

(51) Int. Cl.
*B26B 19/20* (2006.01)
*B26B 19/28* (2006.01)
*B26B 19/38* (2006.01)

(52) U.S. Cl.
CPC ..... *B26B 19/20* (2013.01); *B26B 19/284* (2013.01); *B26B 19/3813* (2013.01); *B26B 19/3846* (2013.01); *B26B 19/3893* (2013.01)

(56) References Cited

U.S. PATENT DOCUMENTS 1,774,046 A * 8/1930 Wahl ..... B26B 19/205 30/201
1,988,199 A * 1/1935 Greco ..... B26B 19/20 30/202
2,013,279 A * 9/1935 Maleev ..... B26B 19/20 30/202
2,726,447 A * 12/1955 Maloy ..... B26B 19/205 30/202
2,941,293 A * 6/1960 Mazzoni ..... B26B 19/20 30/201
3,264,735 A * 8/1966 Du Charme ..... B26B 19/20 30/201
4,581,822 A 4/1986 Fujimura
5,092,186 A * 3/1992 Frank ..... A61C 17/40 74/25
5,325,589 A 7/1994 Kubo
5,367,772 A * 11/1994 Ogawa ..... B26B 19/205 30/201
5,988,999 A 11/1999 Sato
6,260,276 B1 7/2001 Lebherz
7,509,743 B2 * 3/2009 Oh ..... B26B 19/06 30/200
7,536,790 B2 * 5/2009 Ebenhoch ..... B26B 19/06 30/195
8,341,846 B1 * 1/2013 Holmes ..... B26B 19/205 30/200
2008/0163495 A1 * 7/2008 Smal ..... B26B 19/20 30/202
2012/0216411 A1 * 8/2012 Wevers ..... B26B 19/20 30/123
2014/0331503 A1 * 11/2014 Uit De Bulten ..... B26B 19/20 30/201

FOREIGN PATENT DOCUMENTS

EP 1710055 A1 10/2006
EP 1880811 A1 1/2008
WO 2013080114 A1 6/2013

* cited by examiner

HAIR CLIPPING DEVICE

This application is the U.S. National Phase application under 35 U.S.C. § 371 of International Application No. PCT/EP2015/074780, filed on Oct. 27, 2015, which claims the benefit of International Application No. 14192128.8 filed on Nov. 6, 2014. These applications are hereby incorporated by reference herein.

FIELD OF THE INVENTION

The present invention relates to a hair clipping device, in particular to a hair clipping device that is adapted to variably adjust the length of the haircut.

BACKGROUND OF THE INVENTION

Electric haircutting appliances are generally known and include trimmers, clippers and shavers whether powered by main-supplied electricity or battery-driven. Such devices are generally used to trim body hair, in particular facial and head hair to allow a person to have a well-groomed appearance.

Commonly, conventional devices for cutting hair comprise a main body forming an elongated housing having a front or cutting end and an opposite handle end. A cutting assembly is disposed at the front end. The cutting assembly usually comprises a stationary cutting blade, which is sometimes also referred to as "guard", and a moveable cutting blade, which is sometimes also referred to as "cutter". The moveable cutting blade is displaceably mounted on the top surface of the stationary cutting blade and resiliently biased against said top surface of the stationary cutting blade. The cutting assembly itself is usually fixed in a single position relative to the housing of the hair clipping device, such that the orientation of the cutting assembly is determined by a user orientating the housing of hair clipping device. The tips of cutting blades usually jut out of the front side of the hair clipper housing, such that the tips of the cutting blades are always visible to the user. This makes it easier for the user to see where exactly the hairs are cut, which is especially advantageous when using the hair clipper to form and create fine hair contours.

Since there is a great user demand for hair clipping devices that offer the possibility to be used for different haircut lengths, many known hair clipping devices make use of separate, differently sized comb attachments. These comb attachments are generally mounted over the cutting assembly to the front end of the housing of the hair clipping device to position the cutting assembly relative to the skin. In other words, such a comb attachment is used as a guide that moves over the skin and guides hair towards the cutting assembly. Typically, these comb attachments are mounted over the cutting assembly and space the cutting blades apart from the surface of the skin from which the hairs extend. However, always having to replace the comb attachment by a different one when the haircut length shall be changed might be cumbersome for the user, as this is not only time consuming, but the user also has to store a plurality of differently sized comb attachments.

Therefore, a lot of prior art hair clipping devices use only one comb attachment that is adjustable in different positions relative to the hair clipper housing. The user may then shift the comb attachment between different positions leading to different haircut lengths. These moveable comb attachments may, for example, be adjusted between haircut lengths of 3 mm, 5 mm, 7 mm, 9 mm and 11 mm. Of course, other adjustable ranges and steps are possible. These systems, however, include the disadvantage that they only allow for haircut lengths of 3 mm and above, since these lengths are usually the smallest lengths that can be reached with the comb attachment in its shortest position. Of course, the user may also use the hair clipping device without comb attachment, which usually leads to a haircut length of 0.3 mm. However, haircut lengths in between these limit ranges, e.g. in between 0.3 mm and 3 mm, cannot be accomplished with such systems.

Further hair clipping devices are known from the prior art that allow an adjustment for smaller cutting length ranges, i.e. between 0.3 mm and 3 mm. These systems usually enable an adjustment of the position of the moveable cutting blade with respect to the stationary cutting blade in order to increase or decrease the distance between the tips of the cutting blades. The moveable cutting blade may in this case be arranged in different positions along an axis that is perpendicular to the axis along which the moveable cutting blade reciprocates relative to the stationary cutting blade during use. This type of haircut length adjustment is also denoted as "tip-to-tip adjustment", wherein the distance between the tips of the cutting teeth of the moveable cutting blade and the tips of the cutting teeth of the stationary cutting blade is denoted as "tip-to-tip distance".

WO 2013/080114 A1 discloses a hair clipping device to which a comb attachment may be attached. This hair clipping device allows adjusting the haircut length both by means of adjusting the position of the comb attachment relative to the hair clipper housing as well as by means of adjusting the tip-to-tip distance. However, the tip-to-tip distance may only be adjusted if the comb attachment is removed from the hair clipping device. If the comb attachment is attached to the hair clipping device, the moveable cutting blade will be automatically pushed into its foremost position by means of a blocking element. As long as the comb attachment is attached to the hair clipping device, the tip-to-tip adjustment is so to say disengaged. As a consequence this means that for longer haircut lengths the user may attach the comb attachment and then adjust the position of the comb attachment relative to the hair clipper housing for the variety of possible haircut lengths. If, on the other hand, the user needs a shorter haircut length, e.g. in the range of 0.3 mm to 3 mm, the user has to detach the comb attachment in order to be able to adjust the tip-to-tip distance. This might appear to be cumbersome for some users.

WO 2013/080114 A1 discloses a further embodiment that enables adjusting the tip-to-tip distance simultaneously with an adjustment of the position of the comb attachment. However, in this case both adjustment types are linked to each other, such that increasing the distance of the comb attachment to the hair clipper housing at the same time also increases the tip-to-tip distance even if this is not necessarily desired.

There is thus still room for improvement.

SUMMARY OF THE INVENTION

It is an object of the present invention to provide a hair clipping device which overcomes the above-mentioned problems. It is particularly an object to provide a hair clipping device that enables a variable haircut length setting by means of both an adjustment of a comb attachment as well as an adjustment of the tip-to-tip distance. In this case it would be particularly beneficial if the tip-to-tip distance could be adjusted even if the comb attachment is attached to the hair clipping device, wherein an adjustment of the tip-to-tip distance does not lead to a simultaneous adjustment of the comb attachment.

This problem is solved by a hair clipping device comprising:

a housing;

a cutting assembly which comprises a stationary cutting blade and a moveable cutting blade;

a drive arrangement for driving the moveable cutting blade relative to the stationary cutting blade in an oscillatory movement along a first axis;

a comb support element for removably attaching a comb attachment with a plurality of comb teeth;

an adjustment unit for adjusting the position of the comb attachment relative to the cutting assembly when the comb attachment is attached to the comb support element, wherein the adjustment unit is configured to increase a distance between the comb attachment and the cutting assembly during an extension movement of the adjustment unit, and to decrease the distance between the comb attachment and the cutting assembly during a retraction movement of the adjustment unit; and an end stop element which is configured to prevent a movement of the comb attachment towards the cutting assembly during the retraction movement when a minimal distance between the comb attachment and the cutting assembly is reached, wherein the end stop element is further configured to cause a coupling of the adjustment unit with one of the stationary cutting blade and the moveable cutting blade if the retraction movement of the adjustment unit is continued after a contact of the comb attachment with the end stop element, and wherein said coupling enables an adjustment of the position of the moveable cutting blade relative to the stationary cutting blade along a second axis transverse to the first axis by means of the adjustment unit.

According to the present invention, the end stop element is configured to prevent a movement of the comb attachment towards the cutting assembly during the retraction movement by contacting the comb support element, and wherein the end stop element is further configured to cause the coupling of the adjustment unit with one of the stationary cutting blade and the moveable cutting blade if the retraction movement of the adjustment unit is continued after a contact of the end stop element with the comb support element.

The presented hair clipping device enables an adjustment of the haircut length either by means of varying the tip-to-tip distance (for shorter haircut lengths) or by means of varying the position of the comb attachment relative to the housing (for longer haircut lengths). Both the tip-to-tip distance and the position of the comb attachment may be adjusted by one and the same adjustment unit. This adjustment unit may be operated either mechanically or electrically by means of a motor.

In contrast to the hair clipping device known from WO 2013/080114 A1 it is even possible to adjust the tip-to-tip distance when the comb attachment is attached to the hair clipper housing. This significantly increases the user friendliness, since the user does not have to detach the comb attachment even if a variation within a shorter haircut length range is desired. The presented hair clipping device thereto uses a mechanical end stop element which is preferably arranged in the interior of the housing. This end stop element disengages the adjustment of the comb attachment when a minimal distance between the comb attachment and the cutting assembly is reached and engages the adjustment of the moveable cutting blade relative to the stationary cutting blade (tip-to-tip adjustment) at the same time.

The user may vary the haircut length setting in the following way: For longer haircut length settings (e.g. in the range of 3 mm to 12 mm or more) the distance of the comb attachment relative to the cutting assembly may be increased by means of an extension movement of the adjustment unit. Moving the adjustment unit in the opposite way in a retraction movement enables decreasing the distance between the comb attachment and the cutting assembly, i.e. decreasing the haircut length setting in the above-mentioned range until the comb attachment reaches the minimal distance to the cutting assembly and contacts the end stop element. The end stop element then prevents a further movement of the comb attachment towards the cutting assembly. If the retraction movement of the adjustment unit is continued after this point, the adjustment of the comb attachment will be decoupled and the adjustment unit will be coupled to the stationary cutting blade or to the moveable cutting blade so that a continuation of the retraction movement of the adjustment unit will then cause a decrease of the tip-to-tip distance. The haircut length may thus be set to even shorter lengths (e.g. 0.3 mm to 3 mm) until a minimal tip-to-tip distance is reached.

Increasing the haircut length setting again may work the other way round. The user only has to cause the extension movement of the adjustment unit. This causes the tip-to-tip distance to increase until a maximal tip-to-tip distance is reached. At this point the adjustment unit disengages the tip-to-tip adjustment and engages the adjustment of the comb attachment, so that the comb attachment is moved away from the cutting assembly.

It shall be noted that the adjustment of the tip-to-tip distance is realized by a movement of the moveable cutting blade relative to the stationary cutting blade. This shall not imply that the moveable cutting blade has to be necessarily moved along the second axis. It is also possible within the scope of the present invention to move the stationary cutting blade along the second axis, as this will also cause a relative movement of the moveable cutting blade relative to the stationary cutting blade. The end stop element may thus either cause a coupling of the adjustment unit with the stationary cutting blade or a coupling of the adjustment unit with the moveable cutting blade if the retraction movement of the adjustment unit is continued after a contact of the comb attachment with the end stop element.

It shall be furthermore noted that the second axis is preferably perpendicular to the first axis.

The hair clipping device may be used with and without comb attachment. According to an embodiment, the hair clipping device comprises the comb attachment attached to the comb support element. The comb support element is a fixation element that enables a releasable fixture of the comb attachment to the housing of the hair clipper. The comb support element is preferably arranged within the housing and configured to move internally upwards within the housing during the extension movement, and to move internally downwards within the housing during the retraction movement.

According to a further embodiment of the present invention, the adjustment unit comprises an electrical drive. The haircut length may thus be adjusted in a very user-friendly manner. The user him-/herself does not need to manually apply a force for adjusting the position of the comb attachment and/or the tip-to-tip distance.

The presented hair clipping device may comprise a user interface for controlling the drive arrangement and the adjustment unit. This user interface may comprise one or more buttons, e.g. a first button for initializing and stopping the extension movement of the adjustment unit, a second button for initializing and stopping the retraction movement of the adjustment unit and a third button for operating the drive arrangement, i.e. for turning the hair clipping device on and off. Instead of manual buttons the user interface may also comprise a touchscreen. A still further possibility is a manual regulation wheel or slider.

According to an embodiment, the electrical drive comprises an electrical spindle drive. Such an electrical spindle drive allows a relatively high power transmission. Electrical spindle drives are also rather cost-efficient in production and may be installed within the housing of the hair clipping device in a comparatively space-saving manner.

According to a further embodiment, the electrical spindle drive comprises a spindle and a spindle nut which is connected to the comb support element. Turning the spindle causes the spindle nut to move upwards or downwards on the spindle (depending on the movement direction of the spindle). During the extension movement the spindle nut moves in an upward direction on the spindle. During the retraction movement the spindle nut moves in an opposite downward direction.

The end stop element is configured to prevent a movement of the comb attachment towards the cutting assembly during the retraction movement by contacting the spindle nut and/or the comb support element. The contact of the spindle nut and/or the comb support element with the end stop element prevents a further adjustment of the position of the comb attachment. If the spindle is then turned further, the spindle will move relative to the spindle nut. Since a further downward movement of the spindle nut is prevented by means of the end stop element, the spindle will then automatically move upwards. The position of the comb attachment remains constant. This upward movement of the spindle may cause the coupling of the electrical spindle drive with the stationary cutting blade or the moveable cutting blade, such that a continued retraction movement then causes a change of the position of the stationary cutting blade relative to the moveable cutting blade along the second axis. Thus, a rather easy way of disengaging the adjustment of the comb attachment and engaging the tip-to-tip adjustment is accomplished.

The comb attachment preferably comprises at least one cantilever which may be inserted into the housing in order to attach the comb attachment to the comb support element. The connection between the comb support element and the at least one cantilever is preferably manually detachable.

According to a preferred embodiment, the cutting assembly is arranged on a first side of the spindle, and the end stop element is arranged on a second side of the spindle opposite the first side. The hair clipping device may further comprise a first and a second wedge-shaped element for establishing the coupling of the adjustment unit with one of the stationary cutting blade and the moveable cutting blade, wherein the first wedge-shaped element is arranged at the stationary cutting blade or the moveable cutting blade, and wherein the second wedge-shaped element is connected to the spindle.

The longitudinal axis of the spindle is preferably arranged perpendicular to the moveable and the stationary cutting blade. The longitudinal axis of the spindle is, in other words, preferably arranged perpendicular to the first and the second axis. An upward movement of the spindle relative to the end stop element as described above may thus cause a contact between the two wedge-shaped elements, wherein the second wedge-shaped element slides along the first wedge-shaped element along an inclined plane. This causes the stationary cutting blade to move relative to the moveable cutting blade along the second axis.

According to a further embodiment, the second wedge-shaped element is connected to the spindle via a mechanical transmission element which ensures a constant distance between the second wedge-shaped element and the spindle during the extension and retraction movement of the adjustment unit. The mechanical transmission element is preferably coupled to the spindle via a coupler which allows a rotary movement of the spindle relative to the mechanical transmission element. This means that a rotary movement of the spindle does not cause a rotary movement of the second wedge-shaped element. This ensures that the second wedge-shaped element does not rotate relative to the first wedge-shaped element, but may only move upwards or downwards relative thereto. It shall be noted that the second wedge-shaped element only moves upwards or downwards as long as the spindle nut contacts the end stop element, i.e. during a tip-to-tip adjustment, but not during an adjustment of the position of the comb attachment.

According to a further embodiment, the hair clipping device may further comprise a spring element which is arranged between the first wedge-shaped element and a member that is fixedly connected to the mechanical transmission element. This spring element forces the first wedge-shaped element onto the second wedge-shaped element during a tip-to-tip adjustment.

BRIEF DESCRIPTION OF THE DRAWINGS

These and other aspects of the invention will be apparent from and elucidated with reference to the embodiment described hereinafter. In the following drawings

DETAILED DESCRIPTION OF THE EMBODIMENTS

Figure 1:
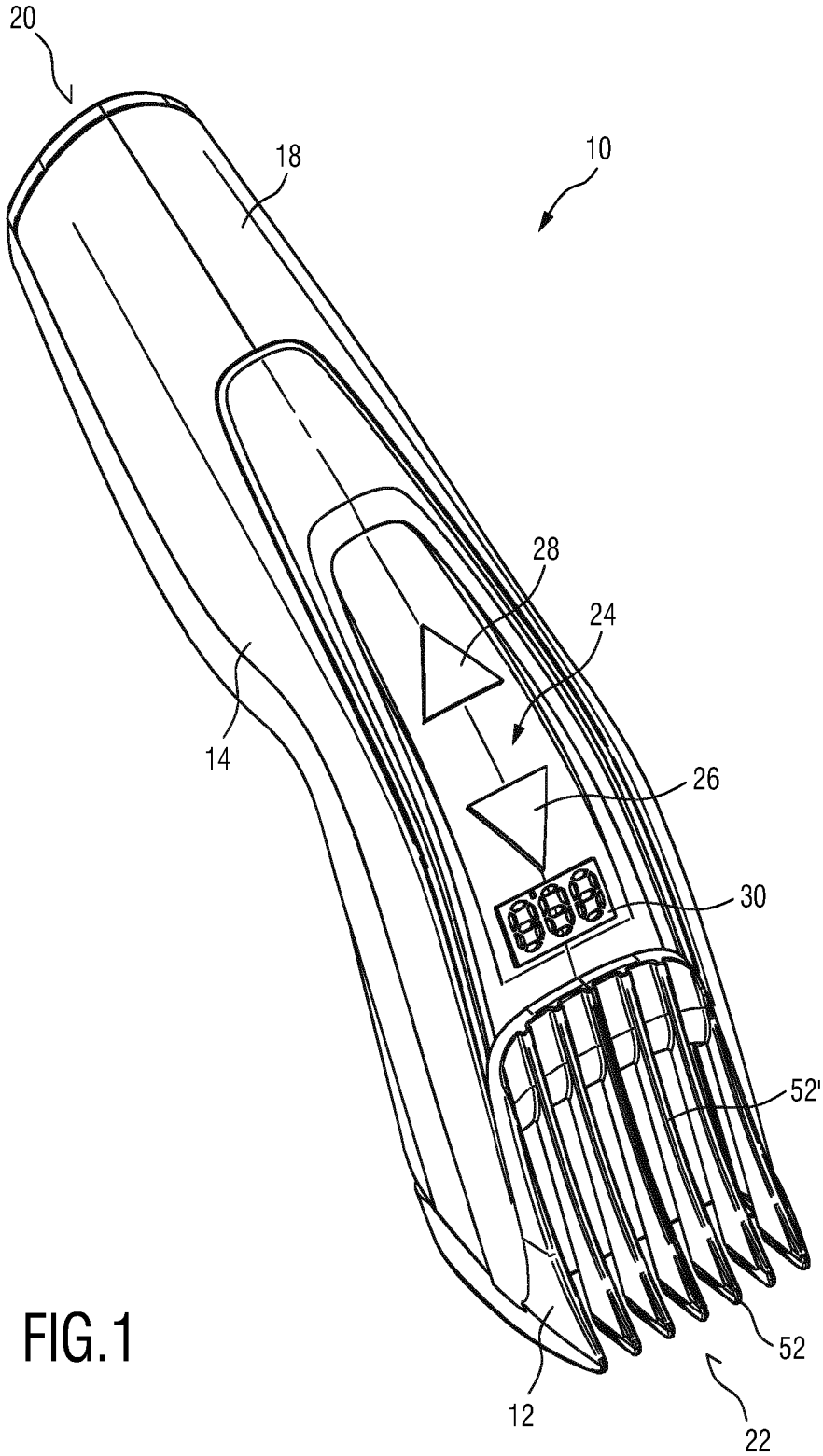
FIG. 1 shows a perspective view of a hair clipping device according to an embodiment of the present invention.

FIG. 1 shows an embodiment of a hair clipping device according to the present invention. The hair clipping device is in its entirety denoted with reference numeral 10.

Figure 2:
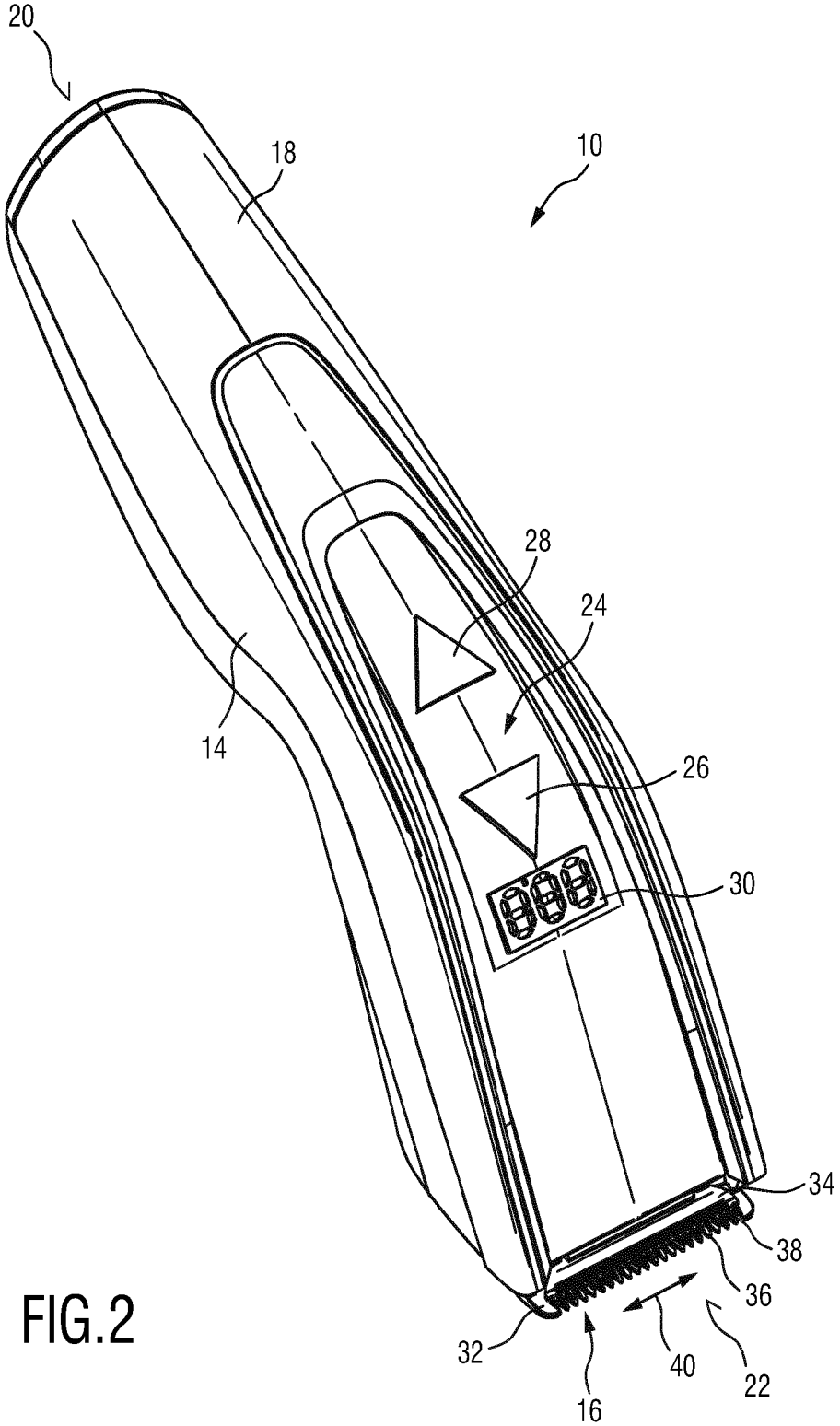
FIG. 2 shows a perspective view of the hair clipping device shown in FIG. 1 without comb attachment.

The hair clipping device 10 comprises a comb attachment 12 that may be releasably attached to the housing 14 of the hair clipping device 10. FIG. 2 shows the hair clipping device 10 without the comb attachment 12.

The housing 14 connects all parts of the hair clipping device 10 together and also serves as a skeleton for a cutting assembly 16 (see FIG. 2). The housing 14 has an elongated body which comprises a handle 18 at its rear end 20. The cutting assembly 16 is fixedly or releasably attached to the opposite front end 22 of the housing 14. The outer surface of the elongated housing 14 may be tapered slightly outwardly from the rear end 20 to the front end 22 and may have a slightly bent development to provide a more ergonomic holding position and to improve the esthetic appearance of the hair clipping device 10. It shall be noted that also other housing arrangements and designs are envisaged without leaving the scope of the present invention.

The hair clipping device 10 further comprises a user interface 24 for controlling the operation of the hair clipping device 10. The user interface 24 comprises a first button 26 for increasing the haircut length setting and a second button 28 for decreasing the haircut length setting. The user interface 24 further comprises a display 30 that shows the user the currently set haircut length. The user interface 24 may additionally comprise a button for turning the hair clipping device 10 on and off. Alternatively, the user interface 24 may comprise a touchscreen which provides the afore-mentioned functions of the buttons 26, 28, the on/off button and the display 30.

The cutting assembly 16 includes a stationary cutting blade 32 and a moveable cutting blade 34 (see FIG. 2). The moveable cutting blade 34 is displaceably mounted on an upper surface of the stationary cutting blade 32 which upper surface faces substantially towards the inner side of the housing 14. The stationary cutting blade 32 and the moveable cutting blade 34 each comprise an array of cutting teeth 36, 38. These cutting teeth 36, 38 are preferably arranged substantially parallel to one another. During operation of the hair clipping device 10 haircutting is performed due to the interaction of the stationary cutting blade 32 and the moveable cutting blade 34. The moveable cutting blade 34 reciprocates in an oscillatory manner along a first axis 40 relative to the stationary cutting blade 32. This oscillatory movement is generated by a drive arrangement 42 which is schematically shown in FIGS. 4 and 5.

The drive arrangement 42 comprises a motor 44 that is either driven by main supplied electricity or battery-driven. The motor 44 drives an eccentric element 46 in a rotary manner. This eccentric element 46 is coupled to a so-called driving bridge 48 that is attached to the moveable cutting blade 34. The driving bridge 48 is used as a coupling element that couples the motor 44 to the moveable cutting blade 34 in order to translate the rotary motor movement into a translational, oscillatory, reciprocal movement of the moveable cutting blade 34 along the first axis 40.

The stationary cutting blade 32 is usually designed to be thicker than the moveable cutting blade 34. Said stationary cutting blade 32 is also denoted as "guard". Its front edge may either be designed as a sharp continuous edge or, similar as the moveable cutting blade 34, as a toothed edge with an array of cutting teeth 36. The moveable cutting blade 34 is also denoted as "cutter".

In order to receive a good cutting performance the moveable cutting blade 34 is actively pressed onto the upper surface of the stationary cutting blade 32 to receive a so-called teeth pressure. A spring (not shown) is usually used to supply said teeth pressure by resiliently biasing the moveable cutting blade 34 against the upper surface of the stationary cutting blade 32.

The comb attachment 12 is releasably attachable to the housing 14. The hair clipping device 10 thereto comprises a comb support element 45 to which the comb attachment 12 may be attached, e.g. by a clip-in (see FIG. 3). In the shown example the comb attachment 12 is fixed to the housing 14 by means of two cantilevers 50 that may be inserted into the housing 14 and engage the comb support element 45 (see FIG. 3). Other possibilities of attaching the comb attachment 12 to the housing 14 are possible as well without leaving the scope of the present invention.

The comb attachment 12 comprises a plurality of comb teeth 52 that are adapted to at least partly surround and/or cover the cutting assembly 16. The comb teeth 52 serve as spacers between the cutting assembly 16 and the skin of the user. The comb attachment 12 may thus be used as a guide that moves over the skin of the user and guides hairs towards the cutting assembly 16. In the shown example the comb attachment 12 comprises two types of comb teeth 52. A first type of comb teeth 52' covers a front side of the housing 14 and the tips of the cutting teeth 36, 38. A second type of comb teeth 52" covers the front end 22 of the housing. In the shown example the comb attachment 12 further comprises an open space or recess 54 between the two types of comb teeth 52', 52". The comb teeth 52', 52" are thus not directly connected to each other. The recess 54 occurs at a position on the front end 22 of the hair clipping device 10 below the cutting assembly 16. This recess 54 improves the cutting performance and prevents a clogging effect, i.e. reduces the risk of hairs getting trapped in between the comb attachment 12 and the housing 14. However, it shall be noted that the recess 54 is not necessarily needed according to the present invention. Other types of comb attachments 12 may be used as well, e.g. comb attachments having only frontal comb teeth 52'.

The presented hair clipping device 10 enables a variation of the haircut length setting either by means of a position adjustment of the comb attachment 12 relative to the housing 14 or by means of an adjustment of the moveable cutting blade 34 relative to the stationary cutting blade 32. The latter-mentioned adjustment is also denoted as "tip-to-tip adjustment", since the haircut length is adjusted by means of adjusting the distance between the tips of the cutting teeth 36 of the stationary cutting blade 32 and the tips of the cutting teeth 38 of the moveable cutting blade 34. This distance is denoted as "tip-to-tip distance". The moveable cutting blade 34 is thereto adjusted along a second axis 56 (see FIGS. 5*c* and 5*d*) relative to the stationary cutting blade 32. The second axis 56 is arranged transverse to the first axis 40, preferably perpendicular to the first axis 40.

A relative adjustment of the moveable cutting blade 34 to the stationary cutting blade 32 may be either accomplished by moving the moveable cutting blade 34 along the second axis 56 or by moving the stationary cutting blade 32 along the second axis 56, as this will become clear in the following.

An adjustment of the position of the comb attachment 12 is used for longer haircut length settings, e.g. in a range of 3 mm to 12 mm or even more. The adjustment of the tip-to-tip distance is used for shorter haircut length settings, e.g. in the range of 0.3 mm to 3 mm. Both ways of adjusting the haircut length are achieved by one and the same adjustment unit 58 which will be explained in the following with reference to FIGS. 3, 4 and 5.

Figure 3:
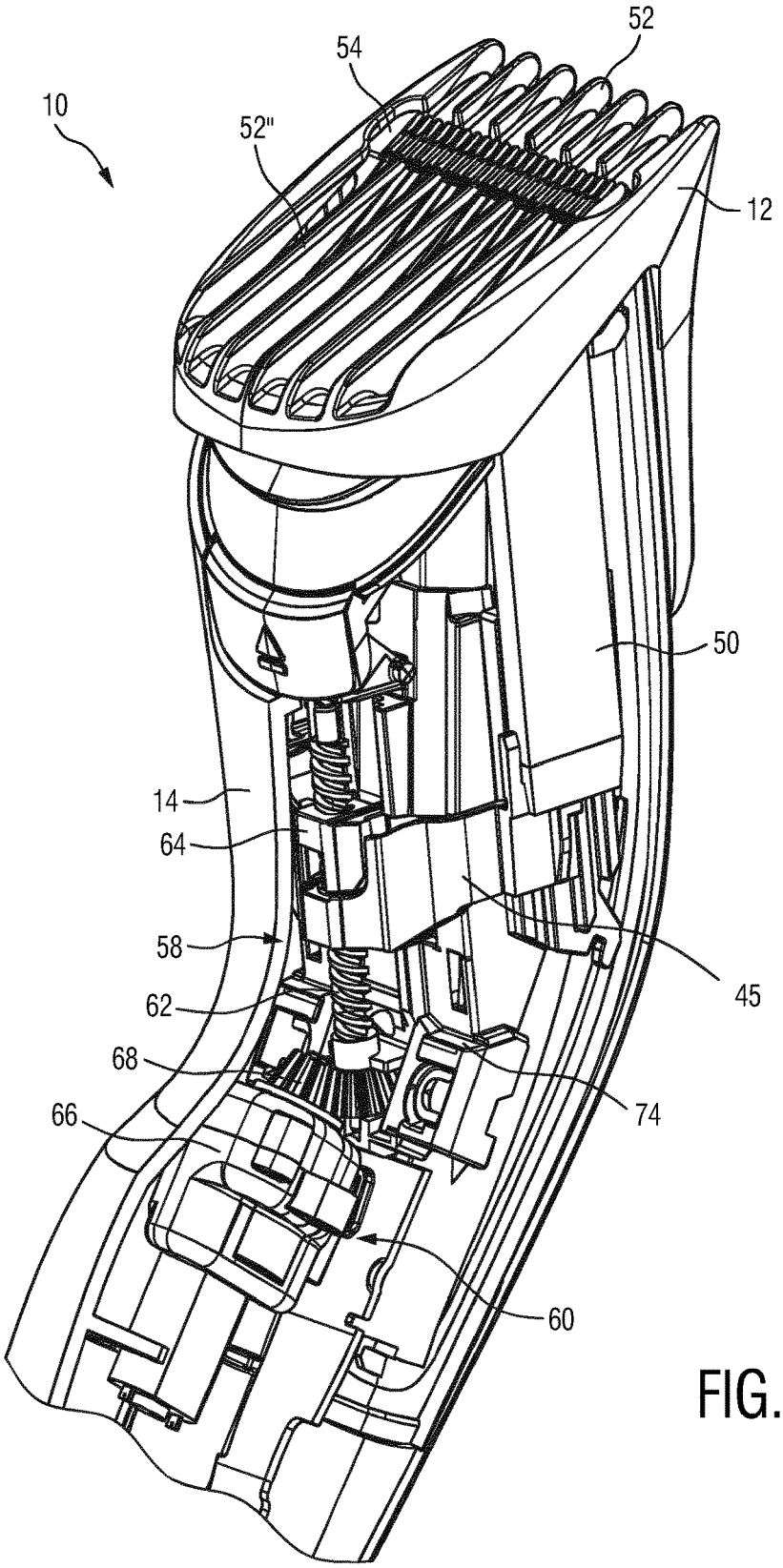
FIG. 3 illustrates an interior of the hair clipping device shown in FIG. 1.

The adjustment unit 58 according to the shown embodiment comprises an electrical drive 60 (see FIG. 3) for adjusting the position of the comb attachment 12 as well as for adjusting the tip-to-tip distance. This electrical drive 60 comprises an electrical spindle drive including a spindle 62 and a spindle nut 64. The electrical drive 60 furthermore comprises an electric motor 66 which is either powered by main supplied electricity or battery-driven. The electric motor 66 drives the spindle 62 in a rotatory manner. The electric motor may be either connected directly to the spindle 62 or, as shown in FIG. 3, via one or more gear pinions 68.

A rotation of the spindle 62 causes the spindle nut 64 to move upwards or downwards on the spindle (depending on the direction of rotation). The spindle nut 64 is releasably connected to the two cantilevers 50 of the comb attachment 12 via the comb support element 45 (see FIG. 3). A rotation of the spindle 62 thus forces the comb support element 45 and the comb attachment 12 (if attached to the housing 14) to move upwards, i.e. away from the front end 22 of the housing 14, to increase the haircut length setting, or downwards, i.e. towards the front end 22 of the housing 14, to decrease the haircut length setting.

The direction of rotation of the spindle 62 may be controlled by means of the afore-mentioned buttons 26, 28. These buttons 26, 28 are preferably connected to the electric motor 66 via a control unit/microprocessor (not shown) which is configured to receive the signals of the button 26, 28 and to control the operation of the electric motor 66 accordingly. The control unit/microprocessor is preferably also connected to the display 30. A user may thus easily adapt the haircut length setting by means of the comb attachment 12, wherein he/she only has to push the first button 26 to increase the haircut length setting or the second button 28 to decrease the haircut length setting.

Figure 4A:
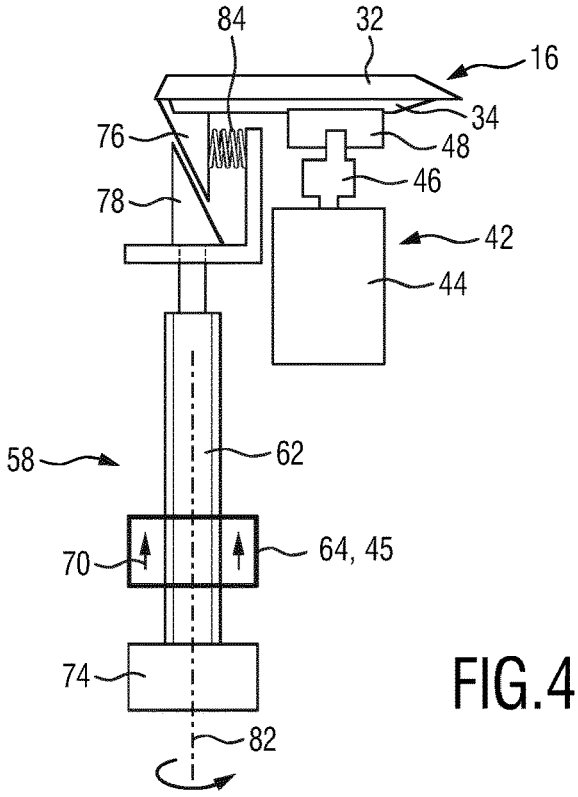
FIGS. 4*a* and 4*b* schematically illustrate how the haircut length setting of the presented hair clipping device may be increased.
Figure 4B:
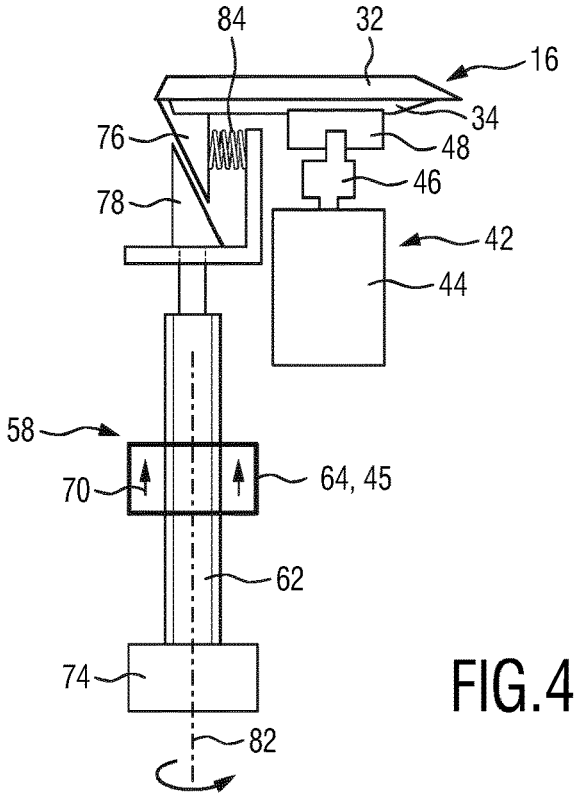

FIGS. 4*a* and 4*b* schematically show the extension movement of the adjustment unit 58 for increasing the haircut length setting by means of the comb attachment 12. The spindle nut 64 thereby moves in an upward direction indicated by arrows 70. It shall be noted that the haircut length is in this example increased only by means of an adjustment of the comb attachment's position, whereas the tip-to-tip distance remains constant.

FIGS. 5*a*-5*d* schematically illustrate the refraction movement of the adjustment unit 58 which is used for decreasing the haircut length setting. An operation of the second button 28 causes the spindle nut 64 to move downwards on the spindle 62 as indicated by arrows 72. Due to the connection of the spindle nut 64 to the comb attachment 12 via the comb support element 45, the comb attachment 12 is thereby also moved downwards, i.e. closer towards the cutting assembly 16 (see FIGS. 5*a* and 5*b*). During the first part of this retraction movement shown in FIGS. 5*a* and 5*b* the tip-to-tip distance still remains constant. However, this changes as soon as the comb support element 45 reaches its lowest position and contacts an end stop element 74. The end stop element 74 is arranged in the interior of the housing 14 and prevents a further down-movement of the comb support element 45 and the spindle nut 64. The end stop element 74 thus also prevents a further down-movement of the comb attachment 12 even if the spindle 62 is rotated further in the retraction direction. The end stop element 74 causes a disengagement of the position adjustment of the comb attachment 12 and at the same time causes a coupling of the adjustment unit 58 with the cutting assembly 16.

Figure 5A:
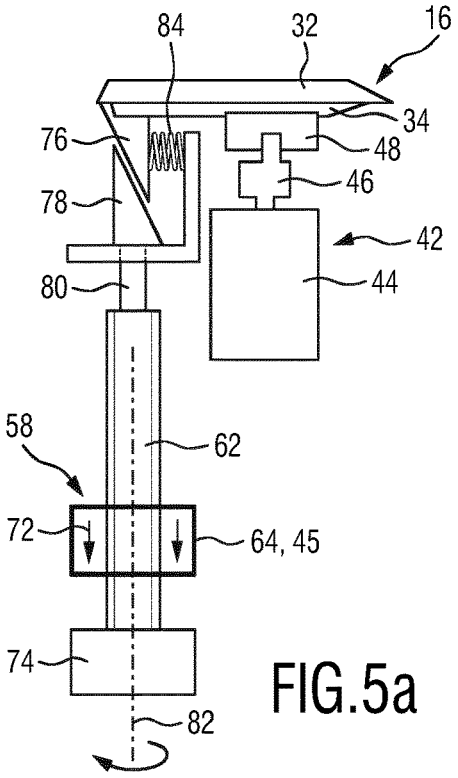
FIGS. 5*a*-5*d* schematically illustrate how the haircut length setting of the presented hair clipping device may be decreased.
Figure 5B:
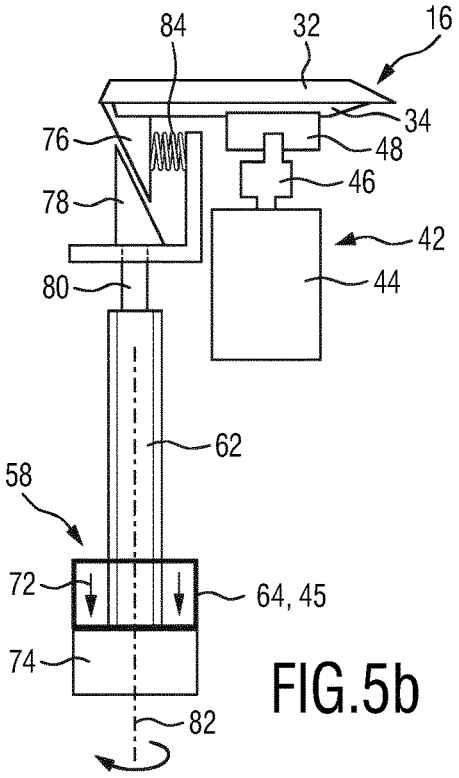
Figure 5C:
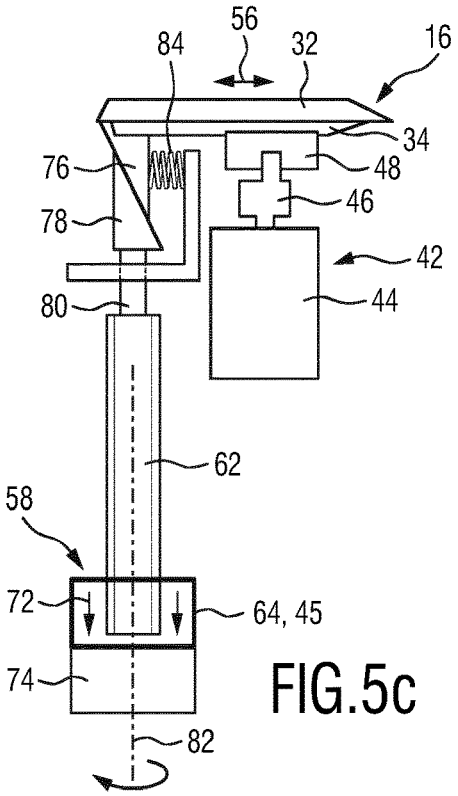
Figure 5D:
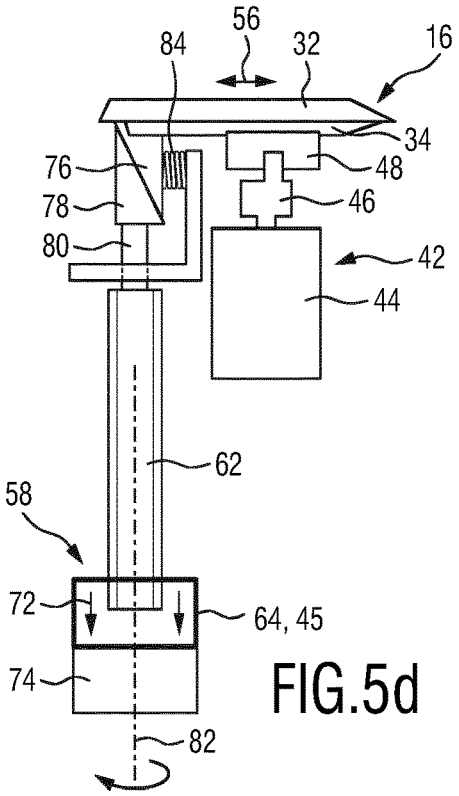

FIGS. 5*c* and 5*d* schematically illustrate the situation if the retraction movement is continued after the spindle nut 64 hits the end stop element 74. A further retraction movement then leads to an adjustment of the tip-to-tip distance and thereby to a further decrease of the haircut length. The adjustment of the tip-to-tip distance is achieved by means of two wedge-shaped elements 76, 78. The first wedge-shaped element is connected to the moveable cutting blade 34. The second wedge-shaped element 78 is connected to the spindle 62 via a mechanical transmission element 80. Said mechanical transmission element 80 ensures a constant distance between the second wedge-shaped element 78 and the spindle 62 during the movement of the spindle 62. The mechanical transmission element 80 is coupled to the spindle 62 via a coupler (not shown) which allows a rotary movement of the spindle 62 relative to the mechanical transmission element 80 such that the mechanical transmission element 80 only moves upwards or downwards, but does not rotate when the spindle 62 rotates about its longitudinal axis 82. The mechanical transmission element 80 is connected to the first wedge-shaped element 76 via a spring element 84. This spring element 84 gets compressed as soon as the two wedge-shaped elements 76, 78 contact each other. As shown in FIGS. 5*c* and 5*d*, the further refraction movement of the adjustment unit 58 causes a movement of the spindle 62 relative to the end stop element 74 in an upward direction as soon as the spindle nut 64 contacts the end stop element 74. The spindle 62 then moves upwards together with the second wedge-shaped element 78. This leads to a contact of the inclined surfaces of both wedge-shaped elements 76, 78. During the further upward movement of the spindle 62 the second wedge-shaped element 78 pushes the first wedge-shaped element 76 to the right along the second axis 56 and thereby decreases the tip-to-tip distance.

The haircut length setting may thus be continuously or stepwise adjusted from 0.3 mm to 12 mm or even more. The user does eventually not even recognize whether the haircut length is varied by means of the tip-to-tip adjustment or by means of the adjustment of the position of the comb attachment 12.

It shall be noted that the first wedge-shaped element 76 may alternatively be connected to the stationary cutting blade 32. Thereto one has only to flip the two wedge-shaped elements 76, 78 such that there inclined surfaces face towards the opposite direction compared to the situation shown in FIGS. 4 and 5. This would also cause a relative movement of the movable cutting blade 34 relative to the stationary cutting blade 32. It shall be furthermore noted that the longitudinal axis 82 of the spindle 62 is arranged transverse to the first axis 40 and the second axis 56. It is particularly preferred that the longitudinal axis 82 of the spindle 62 is arranged perpendicular to the first axis 40 and the second axis 56. This ensures a good power transmission.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping device comprising:

a housing;

a cutting assembly which comprises a stationary cutting blade and a moveable cutting blade;

a drive arrangement for driving the moveable cutting blade relative to the stationary cutting blade in an oscillatory movement along a first axis, the drive arrangement comprising a motor driving an eccentric element in a rotary manner;

a comb attachment releasably attachable to the housing, the comb attachment comprising a plurality of comb teeth adapted to at least partly surround a comb support element for removably attaching a comb attachment with a plurality of comb teeth;

an adjustment unit for adjusting the position of the comb attachment relative to the cutting assembly when the comb attachment is attached to the comb support element, the adjustment unit including an end stop element, a first wedge-shaped element, a second wedge-shaped element, a spindle, a spindle nut, a mechanical transmission element, a spring element and a member;

wherein the adjustment unit is configured to increase a distance between the comb attachment and the cutting assembly during an extension movement of the adjustment unit, and to decrease the distance between the comb attachment and the cutting assembly during a retraction movement of the adjustment unit;

the end stop element arranged and configured to prevent a movement of the comb attachment towards the cutting assembly during the retraction movement of the adjustment unit when a minimal distance between the comb attachment and the cutting assembly is reached by contacting the comb support element, wherein the end stop element is further configured to cause a coupling of the adjustment unit with one of the stationary cutting blade and the moveable cutting blade if the retraction movement of the adjustment unit is continued after the minimal distance between the comb attachment and the cutting assembly is reached after a contact of the end stop element with the comb support element, wherein said coupling enables an adjustment of the position of the moveable cutting blade relative to the stationary cutting blade along a second axis transverse to the first axis by means of the adjustment unit, and wherein said coupling of the adjustment unit with one of the stationary cutting blade and the moveable cutting blade is established via the first and a second wedge-shaped elements, the first wedge-shaped element being connected to one of the stationary cutting blade and the moveable cutting blade, the second wedge-shaped element being coupled to the spindle of the adjustment unit via the mechanical transmission element to ensure a constant distance between the second wedge-shaped element and the spindle during the extension and retraction movements of the adjustment unit, and wherein the spring element is arranged between the first wedge-shaped element and the member that is fixedly connected to the mechanical transmission element, the spring element arranged and configured to force the first wedge-shaped element onto the second wedge-shaped element during an adjustment.

2. The hair clipping device according to claim 1, wherein the adjustment unit comprises an electrical drive.

3. The hair clipping device according to claim 1, wherein the comb attachment comprises at least one cantilever which may be inserted into the housing in order to attach the comb attachment to the comb support element.

4. The hair clipping device according to claim 1, wherein the cutting assembly is arranged on a first side of the spindle, and wherein the end stop element is arranged on a second side of the spindle opposite the first side.

5. The hair clipping device according to claim 1, wherein a longitudinal axis of the spindle is arranged transverse to the first and second axis.

6. The hair clipping device according to claim 1, further comprising a user interface for controlling the drive arrangement and the adjustment unit.

7. The hair clipping device according to claim 1, wherein the eccentric element of the drive arrangement is coupled to a driving bridge attached to the movable cutting blade.

8. The hair clipping device according to claim 7, wherein the driving bridge comprises a coupling element for coupling the motor to the movable cutting blade.

9. The hair clipping device according to claim 7, wherein the cutting assembly is arranged on a first side of the spindle nut.

* * * * *